US008987595B2

(12) United States Patent
Bumgarner

(10) Patent No.: US 8,987,595 B2
(45) Date of Patent: Mar. 24, 2015

(54) ELECTRICAL CONNECTOR, AN INSERT FOR AN ELECTRICAL CONNECTOR AND AN ELECTRICAL ASSEMBLY

(75) Inventor: David Bumgarner, Millers Creek, NC (US)

(73) Assignee: Tyco Electronics Corporation, Berwyn, PA (US)

( * ) Notice: Subject to any disclaimer, the term of this patent is extended or adjusted under 35 U.S.C. 154(b) by 393 days.

(21) Appl. No.: 13/226,620

(22) Filed: Sep. 7, 2011

(65) Prior Publication Data

US 2013/0056268 A1 Mar. 7, 2013

(51) Int. Cl.

| | |
|---|---|
| ***H01R 4/00*** | (2006.01) |
| ***H01R 4/38*** | (2006.01) |
| ***H01R 4/26*** | (2006.01) |
| ***H01R 4/36*** | (2006.01) |
| *H01R 4/50* | (2006.01) |
| *H01R 11/11* | (2006.01) |

(52) U.S. Cl.

CPC ..... *H01R 4/363* (2013.01); *H01R 4/5091* (2013.01); *H01R 11/11* (2013.01)

USPC ..... 174/94 R; 174/84 R; 439/411; 439/775

(58) Field of Classification Search

CPC ..... H01R 4/363; H01R 4/36; H01R 4/30; H01R 11/11; H01R 4/5091; H01R 4/28

USPC ..... 174/84 R, 88 R, 94 R; 439/387, 389, 391, 439/416, 417, 775, 781, 796, 797, 411, 412, 439/485, 800

See application file for complete search history.

(56) References Cited

U.S. PATENT DOCUMENTS

| | | | | |
|---|---|---|---|---|
| 2,988,727 | A * | 6/1961 | Berndt | 439/863 |
| 3,688,247 | A * | 8/1972 | Prodel | 439/416 |
| 4,025,145 | A * | 5/1977 | Shaffer et al. | 439/607.52 |
| 4,103,986 | A * | 8/1978 | Izraeli | 439/811 |
| 4,269,465 | A * | 5/1981 | Mueller | 439/431 |
| 4,620,755 | A * | 11/1986 | Yonkers et al. | 439/99 |
| 4,643,512 | A | 2/1987 | Prodel | |
| 5,000,705 | A | 3/1991 | Kinka et al. | |
| 5,041,012 | A * | 8/1991 | Caprio | 439/413 |
| 5,630,737 | A * | 5/1997 | Dupont | 439/797 |
| 5,821,463 | A * | 10/1998 | Ngo | 174/84 C |
| 6,764,354 | B2 * | 7/2004 | Kaine et al. | 439/793 |
| 6,875,045 | B1 * | 4/2005 | Hollick | 439/411 |
| 7,104,832 | B2 * | 9/2006 | Campbell et al. | 439/411 |

(Continued)

FOREIGN PATENT DOCUMENTS

EP 2128932 A2 12/2009

OTHER PUBLICATIONS

International Search Report, International Application No. PCT/US2012/053717, International Filing Date May 9, 2012.

"New Aluminum Shearbolt Connectors for Underground Splicing", http://www.managingautomation.com/maonline/news/product/read/New_Aluminum_Shea . . . , posted Feb. 2006, 2 pgs.

"Copper ShearBolt Connectors 2/0 AWG compact to 750 kcmil compact", Tyco Electronics, Mar. 2004, 2 pgs.

*Primary Examiner* — Angel R Estrada
*Assistant Examiner* — Dimary Lopez Cruz

(57) ABSTRACT

An electrical connector, an insert for an electrical connector, and an electrical assembly are disclosed. The electrical connector includes a conductive housing and a conductive insert positioned within the conductive housing. The conductive housing includes a configuration for receiving a conductor and being in electrical communication with the conductor through the insert.

19 Claims, 4 Drawing Sheets

(56) References Cited

U.S. PATENT DOCUMENTS

| | | | | |
|---|---|---|---|---|
| 8,475,204 | B2 * | 7/2013 | Blasick et al. | 439/578 |
| 2003/0124915 | A1 | 7/2003 | Kaine et al. | |
| 2007/0287323 | A1 | 12/2007 | Colescott et al. | |
| 2010/0003846 | A1 | 1/2010 | Diniz et al. | |
| 2010/0120300 | A1 | 5/2010 | Battle | |

* cited by examiner

ELECTRICAL CONNECTOR, AN INSERT FOR AN ELECTRICAL CONNECTOR AND AN ELECTRICAL ASSEMBLY

FIELD OF THE INVENTION

The present invention is directed to electrical connectors and electrical connector assemblies and more specifically, to a shear bolt connector with an insert.

BACKGROUND OF THE INVENTION

Utility transmission lines can include electrical connectors and/or electrical connector assemblies positioned overhead or buried underground. For example, known shear bolt connectors serve as underground splices of copper cables between 2/0 AWG to 75 kcmil and for applications up to 35 kV. Shear bolt connectors include a housing for receiving conductors and employ bolts that can be rotated to extend into the housing to physically contact and screw into the conductors to secure the conductors to the housing.

Untimely interruptions to electrical transmission can occur when conductors become separated or dislodged from the housing. This can be both time consuming and costly to any power provider.

Shear bolt connectors suffer from the drawback that the signals travelling through to the bolt are limited by the amount of contact between the conductor and the bolt. The amount of contact is limited by the threaded end of the bolt and the amount of deformability of the conductor. For example, the threaded end of the bolt limits the amount of contact by creating an uneven interface with the conductor (the conductor can be generally cylindrical and the bolt can have a planar or inconsistent threaded end). The amount of deformability of the conductor limits the amount of contact by limiting the ability of the bolt to penetrate into the conductor, thus limiting the amount of contact. With conductors having little deformability, such limitations increase a risk of the conductors being disconnected from the housing of the electrical connector. In addition, when the bolts directly deform the conductor, strands on the conductor can be severed, thereby reducing the ability to retain tension, especially when the bolts are repeatedly loosened and tightened.

An electrical connector, a conductive insert, and an electrical connector assembly, not suffering from one or more of the above drawbacks would be desirable in the art.

BRIEF DESCRIPTION OF THE INVENTION

In an exemplary embodiment, an electrical connector includes a conductive housing and a conductive insert positioned within the conductive housing, and a bolt position within the conductive housing. The conductive housing includes a configuration for receiving a conductor and being in electrical communication with the conductor through the insert. The bolt is positioned within the housing and positioned to urge the conductive insert against the conductor when the bolt is adjusted.

In another exemplary embodiment, a conductive insert for an electrical connector includes engagement features capable of deformably engaging a conductor and a bolt recess positioned on a side opposite the engaging features. The conductive insert includes a curved geometry.

In another exemplary embodiment, a connector assembly includes an electrical connector comprising a conductive housing and a conductive insert positioned within the conductive housing, the conductive insert having engagement features and a conductor positioned within the conductive insert. The conductive insert is deformably engaged to the conductor by a bolt positioned within the conductive housing.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Provided is an electrical connector assembly, an electrical connector, and a conductive insert. Embodiments of the present disclosure provide increased retention for electrical connectors in comparison to similar electrical connectors devoid of the conductive insert, provide increased conductivity between conductors in comparison to similar electrical connectors devoid of the conductive insert, provide versatility with various size conductors, distribute force over a conductor thereby reducing or eliminating severing of conductor strands, and combinations thereof.

Figure 1:
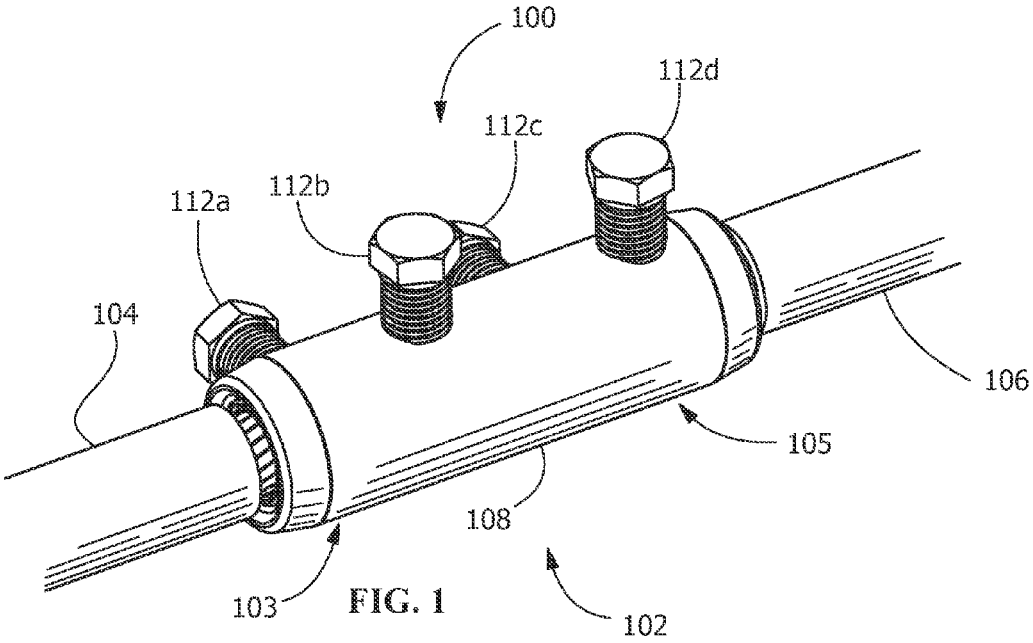
FIG. 1 is a perspective view of an exemplary electrical connector assembly installed between two conductors according to an embodiment of the present invention.

FIG. 1 shows an electrical connector assembly 100 including an electrical connector 102, a first conductor 104, and a second conductor 106. The electrical connector assembly 100 is for any suitable application. For example, in one embodiment, the electrical connector assembly 100 is a utility connector for being positioned overhead. In another embodiment, the electrical connector assembly 100 is a utility connector for being positioned underground.

The electrical connector 102 electrically connects the first conductor 104 to the second conductor 106. The first conductor 104 and the second conductor 106 are electrically conductive conductors, such as stranded cables, capable of transmitting electrical power and/or signals. In one embodiment, the first conductor 104 and the second conductor 106 include the same material, for example, copper or aluminum. In another embodiment, the first conductor 104 and the second conductor 106 include differing materials, for example, the first conductor 104 being copper and the second conductor 106 being aluminum. In one embodiment, the first conductor 104 and the second conductor 106 are the same size and/or shape. In another embodiment, the first conductor 104 and the second conductor 106 have differing sizes and/or shapes, for example, the first conductor 104 having a thickness that is greater or smaller than the second conductor 106.

Figure 2:
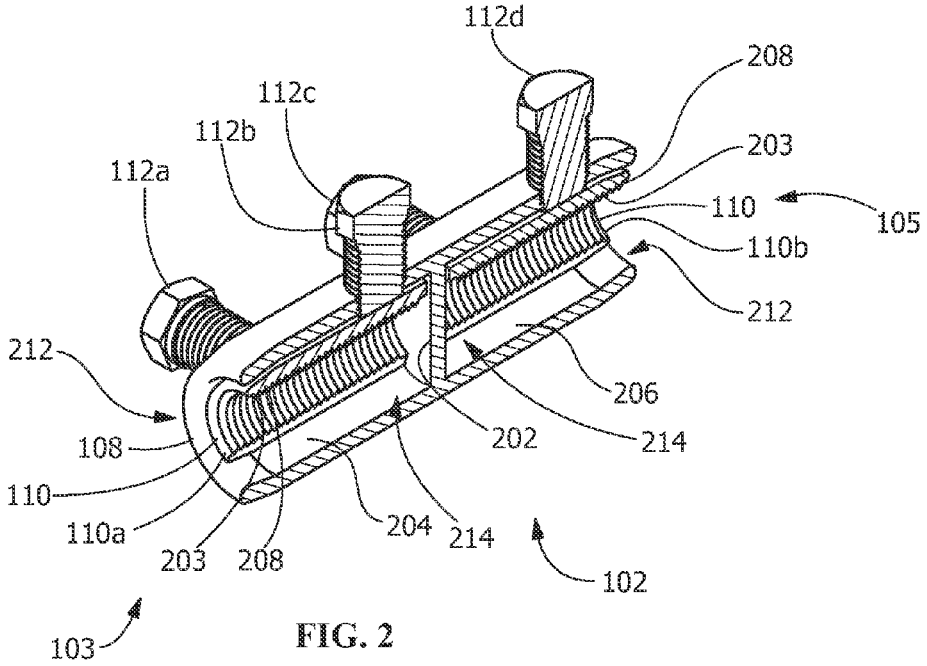
FIG. 2 is a cutaway section of an exemplary electrical connector according to an embodiment of the present invention.

Referring to FIG. 2, the electrical connector 102 includes a conductive housing 108 and a conductive insert 110 positioned within the conductive housing 108 to receive and retain the first conductor 104 (see FIG. 1) and/or the second conductor 106 (see FIG. 1). The conductive housing 108 is in electrical communication with the first conductor 104 and the second conductor 106 through the conductive insert 110.

The conductive housing 108 includes any suitable material. In one embodiment, for example, as in an overhead application, the conductive housing 108 includes aluminum. In another embodiment, for example, as in an underground application, the conductive housing 108 includes copper.

Figure 3:
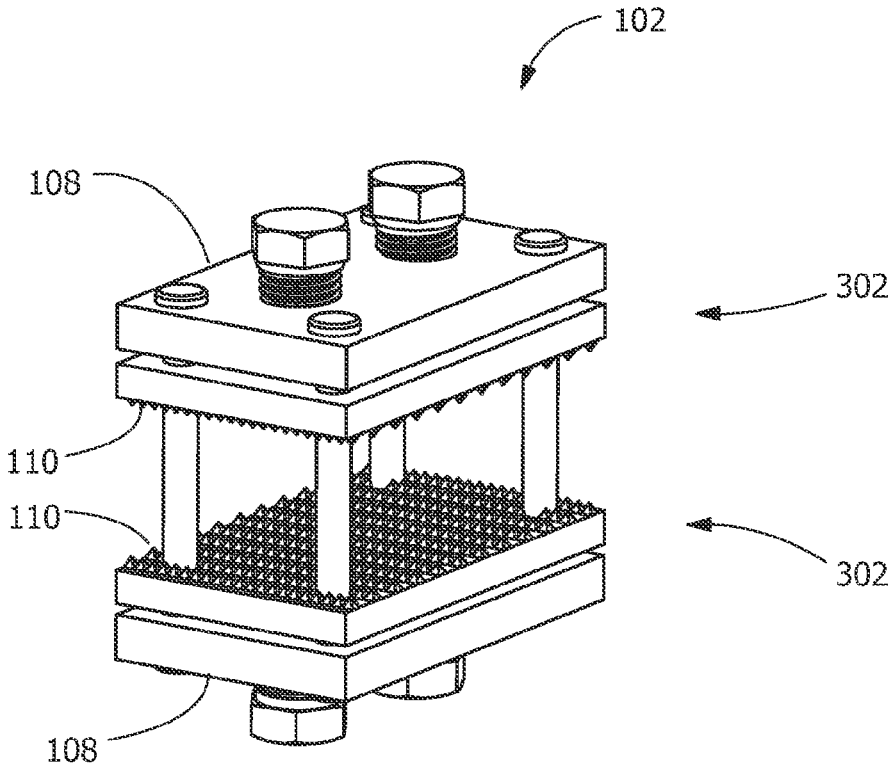
FIG. 3 is a perspective view of another exemplary electrical connector according to an embodiment of the invention.

The conductive housing 108 is any suitable geometry. As shown in FIG. 1, in one embodiment, the conductive housing 108 is frusto-conical. In another embodiment, as shown in FIG. 3, the conductive housing 108 is a substantially planar portion 302 of the electrical connector 102 with the conductive inserts 110 having a corresponding geometry. In yet another embodiment, the conductive housing 108 is cylindrical, rectangular, cuboid, hex-shaped, or any other suitable geometry with the conductive insert 110 having a corresponding geometry.

Referring again to FIG. 1, the conductive housing 108 includes any suitable features for securing the conductive insert 110 in a predetermined position. For example, in one embodiment, the conductive housing 108 includes an adhesive (not shown) applied between the conductive housing 108 and the conductive insert 110 to retain the conductive insert 110 in place during positioning of the first conductor 104 (see FIG. 1) and/or the second conductor 106 (see FIG. 1). In one embodiment, the adhesive is a temporary adhesive that is only present during assembly and does not affect electrical conductivity during operation of the electrical connector assembly 100. In one embodiment, the conductive housing 108 includes suitable alignment or securing features (not shown) for aligning and securing the conductive insert 110 within the conductive housing 108. Suitable alignment or securing features include, but are not limited to, threading, snaps, clips, protrusions, keying, recesses, fasteners, other suitable alignment features, or combinations thereof.

In one embodiment, the conductive housing 108 includes one or more bolts 112 positioned within the conductive housing 108. The one or more bolts 112 extend from outside of the conductive housing 108 through the conductive housing 108 to contact the conductive insert 110 (see FIG. 2). The bolts 112 are positioned so that when adjusted by being rotated they urge the conductive insert 110 against the first conductor 104 and/or the second conductor 106. By urging the bolts 112 toward the conductive insert 110, the conductive insert 110 engages the first conductor 104 or the second conductor 106 and the electrical connection between the first conductor 104 or the second conductor 106 and the conductive housing 108 is formed or increased, thereby forming or increasing the electrical connection between the first conductor 104 and the second conductor 106.

As shown in FIG. 1, in one embodiment, four of the bolts 112 are included. A first bolt 112*a* and a second bolt 112*b* are on a first portion 103 proximal to the first conductor 104 of the conductive housing 108. A third bolt 112*c* and a fourth bolt 112*d* are on a second portion 105 of the conductive housing 108 proximal to the second conductor 106. The first bolt 112*a* and the second bolt 112*b* correspond to a first conductive insert 110*a* (for example, see FIG. 2) positioned within the conductive housing 108 proximal to the first conductor 104. Similarly, the third bolt 112*c* and the fourth bolt 112*d* on the portion of the conductive housing 108 proximal to the second conductor 106 correspond to a second conductive insert 110*b* (for example, see FIG. 2) positioned within the conductive housing 108 proximal to the second conductor 106. As will be appreciated, fewer than four bolts 112 or more than four bolts 112 can be included. Likewise, the arrangement of the bolts 112 may be in any suitable orientation.

The conductive housing 108 retains the first conductor 104 and/or the second conductor 106 within the conductive housing 108 and/or the conductive inserts 110. In one embodiment, the conductive housing 108 is arranged and disposed for the first conductor 104 and the second conductor 106 to be positioned to abut each other (not shown) or proximate with each other within the conductive housing 108. Referring to FIG. 2, in another embodiment, the conductive housing 108 includes an interior wall 202 separating a first conductor region 204 and the first conductor 104 from a second conductor region 206 and the second conductor 106. The first conductor region 204 and the second conductor region 206 of housing 108 each include an end portion 212 and an internal portion 214. The corresponding end portions 212 are configured to receive the first conductor 104 or second conductor 106, and during installation, the ends of the first conductor 104 and second conductor 106 are positioned within the corresponding internal portions 214, and are positioned to be abutting and contacting the interior wall 202.

The conductive insert 110 is configured to securely retain the first conductor 104 (see FIG. 1) within the first conductor region 204 and/or the second conductor 106 (see FIG. 1) within the second conductor region 206. The retention of the first conductor 104 and/or the second conductor 106 is achieved by any suitable mechanism or features on the conductive insert 110 arranged and disposed for contacting the first conductor 104 and/or the second conductor 106. As shown in FIG. 2, in one embodiment, the conductive insert 110 includes engagement features 208, such as peaks or ridges, for securely engaging the first conductor 104 and/or the second conductor 106. The engagement features 208 are positioned on an engagement surface 203 of the conductive insert 110. During installation, the first conductor 104 and second conductor 106 are positioned within the conductive insert 110, adjacent to the engagement surface 203. In one embodiment, the engagement features 208 deformably engage the first conductor 104 and/or the second conductor 106 upon the conductive insert 110 being urged toward the first conductor 104 (see FIG. 1) and/or the second conductor 106 (see FIG. 1). In other embodiments, the first conductor 104 and/or the second conductor 106 are retained by a rough surface (not shown) on the conductive insert 110, by axial grooves (not shown) on the conductive insert 110, by threading (not shown) on the conductive insert 110, by independent protrusions (not shown) on the conductive insert 110, or combinations thereof.

The engagement features 208 are arranged on the conductive insert 110 in any suitable manner. For example, referring to FIG. 2, in one embodiment, the engagement features 208 are arranged in a consistent periodic arrangement with each of the engagement features 208 extending in a substantially vertical orientation, the orientation essentially perpendicular to the longitudinal axis of the conductive insert 110.

Figure 4:
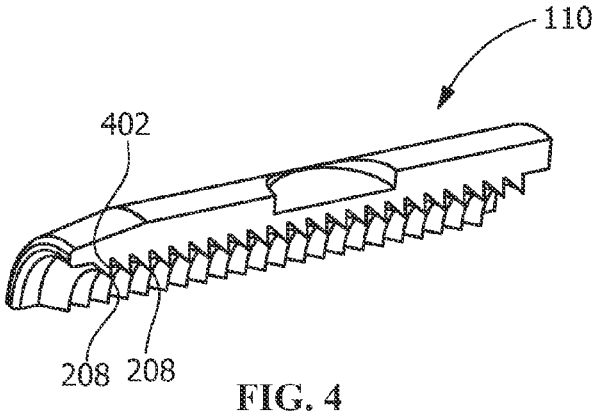
FIG. 4 is a partial perspective view of an exemplary insert for an electrical connector according to an embodiment of the present invention.

Referring to FIG. 4, in another embodiment, the engagement features 208 are arranged in a consistent periodic arrangement and each of the engagement features 208 extend at an angle 402, relative to the longitudinal axis of the conductive insert 110, other than vertical, for example, directed toward the end portion 212 (see FIG. 2) of a corresponding conductive housing 108 or the internal portion 214 (see FIG. 2) of the corresponding conductive housing 108.

Figure 5:
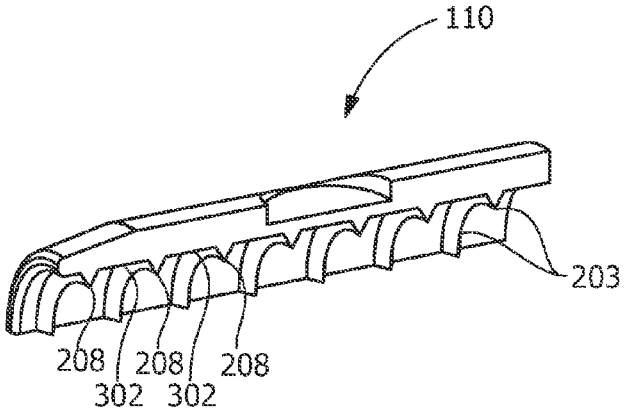
FIG. 5 is a partial perspective view of another exemplary insert for an electrical connector according to an embodiment of the invention.

Referring to FIG. 5, in one embodiment, the engagement features 208 are separated by substantially planar portions 302 between each of the engagement features 208 on the engagement surface 203.

Figure 6:
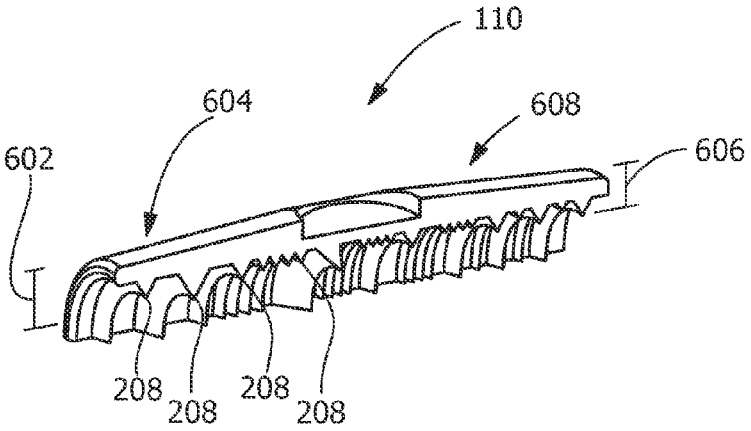
FIG. 6 is a partial perspective view of yet another exemplary insert for an electrical connector according to an embodiment of the present invention.

Referring to FIG. 6, in yet another embodiment, the engagement features 208 are arranged in a non-periodic arrangement and/or include engagement features 208 of differing heights, shapes, orientations, or combinations thereof.

The conductive insert 110 includes any other features capable of engaging the conductive housing 108 and/or retaining the first conductor 104 and/or the second conductor 106. For example, referring to FIG. 6, in one embodiment, the conductive insert 110 includes an increasing thickness, the increasing thickness being formed by a first maximum thickness 602 in a first region 604 being less than a second maximum thickness 606 in a second region 608, or by being otherwise generally tapered, partially tapered, or sloped (independent of the slope formed by the engagement features 208). The first region 604 corresponds to the end portion 212 (see FIG. 2) of the conductive housing 108 or the internal portion 214 (see FIG. 2) of the conductive housing 108, with the second region 608 corresponding to the respective alternative of the end portion 212 (see FIG. 2) of the conductive housing 108 or the internal portion 214 (see FIG. 2) of the conductive housing 108. In contrast, as shown in FIG. 2, in one embodiment, the conductive insert 110 includes a substantially consistent thickness throughout.

Figure 7:
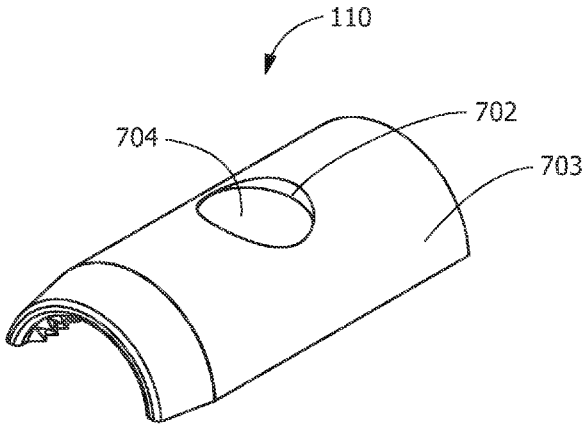
FIG. 7 is a partial perspective view of an exemplary insert for an electrical connector according to an embodiment of the present invention.

Referring to FIG. 7, in one embodiment, an exterior abutment surface 703 of the conductive insert 110 is arranged and disposed to conform to the shape of and to contact the conductive housing 108. In one embodiment, the conductive insert 110 is arranged and disposed to be positioned in a single predetermined orientation within the conductive housing 108 (see FIG. 2). In one embodiment, the conductive insert 110 includes alignment features for being in the predetermined orientation within the conductive housing 108. For example, in one embodiment, the conductive insert 110 includes threading, snaps, clips, protrusions, keying, recesses, fasteners, other suitable alignment features corresponding to the conductive housing 108, or combinations thereof.

Figure 8:
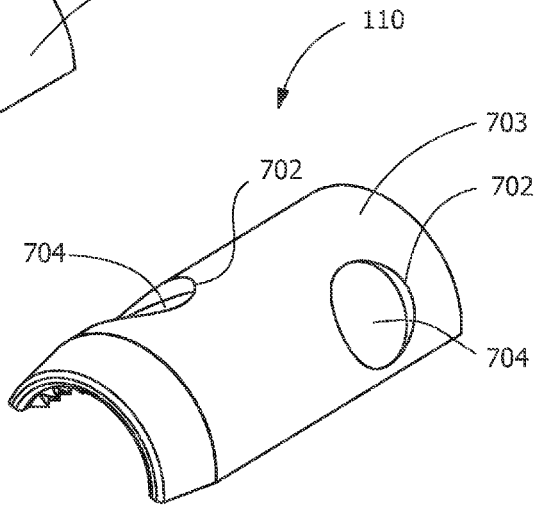
FIG. 8 is a partial perspective view of an exemplary insert for an electrical connector according to an embodiment of the present invention.

Additionally or alternatively, in one embodiment, the conductive insert 110 includes a bolt recess 702 capable of providing alignment and distributing force from one of the bolts 112 (see FIG. 2) along the conductive insert 110. Upon the bolt 112 being adjusted inwardly toward the first conductor region 204 (see FIG. 2) and/or the second conductor region 206, the bolt recess 702 is engaged by the bolt 112. The bolt recess 702 has a geometry corresponding to the bolt 112. In one embodiment, the bolt recess 702 includes a bottom 704 configured to receive and engage the bottom of bolt 112. In one embodiment, the bolt recess 702 includes threading (not shown). As shown in FIG. 8, in one embodiment, the bolt recess 702 is a cylindrical recess that is slightly larger in diameter than the bolts 112. In this embodiment, when the bolt 112 is inwardly adjusted, the bolt 112 engages and applies force to the bottom 704 of the bolt recess 702.

Referring to FIG. 8, in one embodiment, the conductive insert 110 includes two bolt recesses 702 and a generally curved geometry.

Figure 9:
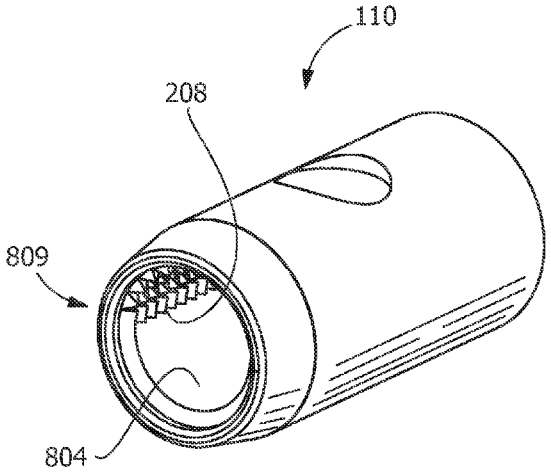
FIG. 9 is a perspective view of an exemplary insert for an electrical connector according to the disclosure.

Referring to FIG. 9, in one embodiment, the conductive insert 110 includes a generally cylindrical geometry with one or more engagement regions 809 having the engagement features 208 and a non-engagement region 804 devoid of the engagement features 208.

Figure 10:
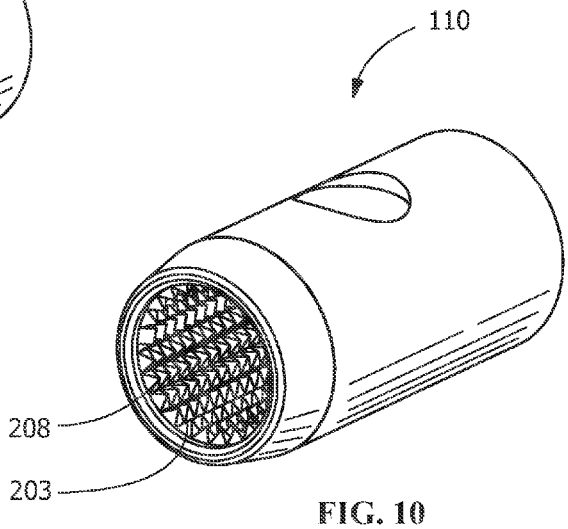
FIG. 10 is a perspective view of an exemplary insert for an electrical connector according to an embodiment of the present invention.

Referring to FIG. 10, in one embodiment, the conductive insert 110 includes engagement features 208 extending throughout the engagement surface 203 to receive the first conductor 104 and/or the second conductor 106 (see FIG. 1).

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An electrical connector, comprising:

a conductive housing; and a conductive insert positioned within the conductive housing;

a bolt positioned within the conductive housing;

wherein the conductive housing includes a configuration for receiving a conductor and being in electrical communication with the conductor through the insert;

wherein the bolt is positioned within the housing and positioned to urge the conductive insert against the conductor when the bolt is adjusted;

wherein the conductive insert includes a bolt recess, a first region extending beyond the bolt recess in a first axial direction consistent with the configuration for receiving the conductor, a second region extending beyond the bolt recess in a second axial direction opposite the first axial direction, a first curved region extending from the bolt recess perpendicular to the first axial direction and curved to engage the conductor, and a second curved region extending from the bolt recess perpendicular to the first axial direction and curved to engage the conductor, wherein the conductive insert is capable of distributing force from the bolt throughout the conductive insert;

wherein the first region, the second region, the first curved region, and the second curved region are arranged for electrical communication with the conductor;

wherein the bolt recess has a diameter that is slightly larger than the diameter of the bolt where the bolt extends through the conductive housing.

2. The electrical connector of claim 1, wherein the conductive insert includes engagement features capable of deformably engaging the conductor.

3. The electrical connector of claim 1, wherein the conductive insert includes a sloped thickness from the first region to the second region, the sloped thickness being independent of a thickness of the engagement features.

4. The electrical connector of claim 3, wherein the first region corresponds to an internal portion of the conductive housing.

5. The electrical connector of claim 3, wherein the first region corresponds to an end portion of the conductive housing.

6. The electrical connector of claim 3, wherein the second region corresponds to an internal portion of the conductive housing.

7. The electrical connector of claim 3, wherein the second region corresponds to an end portion of the conductive housing.

8. The electrical connector of claim 1, wherein the conductive housing includes copper.

9. The electrical connector of claim 1, wherein the conductive housing includes aluminum.

10. The electrical connector of claim 1, wherein the conductive insert includes copper.

11. The electrical connector of claim 1, wherein the conductive insert includes aluminum.

12. The electrical connector of claim 1, wherein the conductive housing includes features for threaded engagement between the conductive housing and the conductive insert.

13. The electrical connector of claim 1, further comprising an adhesive between the conductive housing and the conductive insert.

14. The electrical connector of claim 1, wherein the conductive insert is cylindrical.

15. The electrical connector of claim 1, wherein the conductive insert has a curved non-cylindrical geometry.

16. The electrical connector of claim 1, wherein the conductive insert is a non-periodic arrangement of engagement features.

17. The electrical connector of claim 1, wherein:

the conductive insert includes engagement features capable of deformably engaging the conductor;

the conductive insert includes a sloped thickness from the first region to the second region, the sloped thickness being independent of a thickness of the engagement features, the first region corresponding to an internal portion of the conductive housing and the second region corresponding to an internal portion of the conductive housing;

the conductive housing includes features for threaded engagement between the conductive housing and the conductive insert;

wherein the bolt recess includes threading a generally curved geometry.

18. A conductive insert for an electrical connector, comprising:

engagement features capable of deformably engaging a conductor; and a bolt recess positioned on a side opposite the engaging features;

wherein the conductive insert includes a curved geometry, wherein the conductive insert includes a first region extending beyond the bolt recess in a first axial direction consistent with the configuration for receiving the conductor, a second region extending beyond the bolt recess in a second axial direction opposite the first axial direction, a first curved region extending from the bolt recess perpendicular to the first axial direction and curved to engage the conductor, and a second curved region extending from the bolt recess perpendicular to the first axial direction and curved to engage the conductor, wherein the conductive insert is capable of distributing force from the bolt throughout the conductive insert;

wherein the first region, the second region, the first curved region, and the second curved region are arranged for electrical communication with the conductor.

19. An electrical connector assembly, comprising:

an electrical connector comprising a conductive housing and a conductive insert positioned within the conductive housing, the conductive insert having engagement features; and a conductor positioned within the conductive insert;

wherein the conductive insert is deformably engaged to the conductor by a bolt positioned within the conductive housing;

wherein the conductive insert includes a bolt recess, the bolt recess having a diameter that is slightly larger than the diameter of the bolt where the bolt extends through the conductive housing;

wherein the conductive insert further includes a first region extending beyond the bolt recess in a first axial direction consistent with the configuration for receiving the conductor, a second region extending beyond the bolt recess in a second axial direction opposite the first axial direction, a first curved region extending from the bolt recess perpendicular to the first axial direction and curved to engage the conductor, and a second curved region extending from the bolt recess perpendicular to the first axial direction and curved to engage the conductor, wherein the conductive insert is capable of distributing force from the bolt throughout the conductive insert;

wherein the first region, the second region, the first curved region, and the second curved region are arranged for electrical communication with the conductor.

* * * * *